US005126626A

United States Patent [19]

Iwasaki

[11] Patent Number: 5,126,626

[45] Date of Patent: Jun. 30, 1992

[54] PROJECTION CATHODE RAY TUBE

[75] Inventor: Yasuo Iwasaki, Nagaokakyo, Japan

[73] Assignee: Mitsubishi Denki Kabushiki Kaisha, Tokyo, Japan

[21] Appl. No.: 783,205

[22] Filed: Oct. 28, 1991

Related U.S. Application Data

[62] Division of Ser. No. 650,022, Feb. 4, 1991.

[30] Foreign Application Priority Data

Mar. 29, 1990 [JP] Japan ..... 2-86122

[51] Int. Cl.[5] ..... H01J 29/10; B05D 5/06

[52] U.S. Cl. ..... 313/474; 313/473; 313/466; 313/112; 427/64; 427/73; 358/250; 358/253

[58] Field of Search ..... 313/473, 474, 466, 112; 427/64, 73, 294; 358/250, 253, 230, 233

[56] References Cited

U.S. PATENT DOCUMENTS

| | | | |
|---|---|---|---|
| 4,609,267 | 9/1986 | Deguchi et al. | 427/294 |
| 4,634,926 | 1/1987 | Vriens et al. | 313/474 |
| 4,642,695 | 2/1987 | Iwasaki | 313/474 |
| 4,683,398 | 1/1987 | Vriens et al. | 313/474 |
| 4,804,884 | 2/1989 | Vriens et al. | 313/474 |

FOREIGN PATENT DOCUMENTS 60-257043 12/1985 Japan .

*Primary Examiner*—Donald J. Yusko
*Assistant Examiner*—Diab Hamadi

[57] ABSTRACT

A high-quality projection cathode ray tube is for projecting the image, displayed on a fluorescent surface, as an enlarged image on a screen in front of the fluorescent surface through a projection lens disposed at a given distance ahead. On the inner surface of a face panel, a multilayer optical interference film including optical thin film layers of alternately superimposed high refractive and low refracte index material is provided. The outermost surface of the multilayer optical interference film is coated with a film of an inorganic material such as silicon dioxide which is optically transparent and stable with respect to the impact of an electron beam. The thickness of the transparent film is not less than 1.0 μm. Even an electron beam having a high energy which has passed through the gaps of the phosphor layer loses the energy in this protective film. Thus, the projection cathode ray tube is capable of reducing the deterioration of the light output with time, by suppressing the browning phenomenon of the glass surface of the face panel and the multilayer optical interference film.

3 Claims, 4 Drawing Sheets

PROJECTION CATHODE RAY TUBE

This application is a divisional of copending application Ser. No. 07/650,022, filed on Feb. 4, 1991, the entire contents of which are hereby incorporated by reference.

BACKGROUND OF THE INVENTION

Field of the Invention

The present invention relates to a projection cathode ray tube for projecting the image, displayed on a fluorescent surface, on a screen in front of the fluorescent surface through a projection lens as an enlarged image. More particularly, the present invention relates to a projection cathode ray tube which is capable of reducing the deterioration of the light output, with time, by suppressing the browning phenomenon of the glass surface of the face panel and the multilayer optical interference film.

Description of the Related Art

In U.S. Pat. No. 4,642,695, filed by the applicant of the present invention, is disclosed a method of ameliorating the defect of a projection television set, namely, the poor convergence ratio exhibited when the beams of the respective monochromes emitted from the projection cathode ray tube are received by the projection lens unit.

In an ordinary cathode ray tube, the light emitted from the fluorescent surface assumes a state approximate to what is called perfect diffusion light. However, but in a projection television set, among the beams emitted from the fluorescent surface, only the rays having a divergence angle of not more than about ±30° are received by the projection lens unit and the other beams are treated as extraneous light. The extraneous light is not only necessary but exerts various deleterious influences. For example, the extraneous light is reflected by a cylindrical mirror of the projection lens unit or the like to become backlight, which lowers the contrast of the projected image. According to the related art disclosed in U.S. Pat. No. 4,642,695, the method is greatly effective for improving the brightness of the image on the screen of a projection television set because not less than 30% of the total light fluxes emitted from a light emitting point of the fluorescent surface is converged into the interior of a conical body having a divergence angle of ±30°.

In Japanese Patent Laid-Open No. 257043/1985, filed to the Japan Patent Office by the applicant of the present invention, a projection cathode ray tube provided with a multilayer optical interference film composed of a plurality of alternately superimposed layers of high refractive and low refractive index materials disposed between the face panel and the fluorescent surface is disclosed as the concrete example of the above-described related art. As an example of the multilayer optical interference film, a multilayer optical interference film is described which is composed of six alternately superimposed layers of tantalum pentoxide ($Ta_2O_5$) as a high refractive index material and silicon dioxide ($SiO_2$) as a low-refractive index material.

In a conventional projection cathode ray tube provided with a multilayer optical interference film on the inner surface of the face panel, the degree to which the light emitted from the projection cathode ray tube is lowered with the operation time is disadvantageously larger than in a projection cathode ray tube having no optical multilayer interference film. FIG. 2 shows a change in the light output with respect to the operation time which is obtained by continuously operating a projection cathode ray tube emitting green light (G) at a high voltage (accelerating voltage) of 32 KV and a current density on the fluorescent surface of 6 $\mu A \cdot cm^{-2}$ (the outer surface of the face panel of the projection cathode ray tube is cooled by a coolant). In FIG. 2, the curve (I) shows the deterioration of the light output of a conventional projection cathode ray tube which has no multilayer optical interference film. It is observed that the light output is lowered to 74% of the initial light output in 7,000 hours. This deterioration will be ascribed to the fact that the luminous efficiency of the phosphor itself is lowered and to the browning phenomenon of the face panel. The ratio of the weights of these causes is considered to be about 50% in the present state of the art.

It is considered that the luminous efficiency of a phosphor is lowered when the luminescent mechanism of the phosphor itself is gradually broken by the energy of the impact of the electron beam and the heat or the X-rays generated thereby. The browning phenomenon is divided into electron beam browning and X-ray browning. Electron beam browning is caused by the reduction of alkaline metal ions such as sodium (Na) ions and potassium (K) ions which constitute the face panel into metals, by the energy produced, when the electron beam which has passed through the gaps of the fluorescent layer directly collides against the inner surface of the face panel. X-ray browning is a kind of solarization and is caused when the energy of the X-rays produced by the electrons which collide against the fluorescent surface or the glass surface at a high speed produces the browning center in the lattice defect in the glass surface of the face panel. If such electron beam browning or X-ray browning is caused, the glass surface of the face panel is tinged with brown and the spectral transmittance is lowered, as shown in the spectral transmittance distribution (b) in comparison with the spectral transmittance distribution (a) before browning in FIG. 3. The lowering of the transmittance becomes larger in the short wavelength range of the visible light.

The curve (II) in FIG. 2 shows the deterioration of the light output of a conventional projection cathode ray tube having a multilayer optical interference film which is composed of a face panel 1, a multilayer optical interference film 2 provided on the inner surface of the face panel and consisting of five alternately superimposed layers of titanium oxide ($TiO_2$) as a high refractive index material and silicon dioxide ($SiO_2$) as a low refractive index material, a phosphor layer 3 and a metal back coat 4 overlaid with each other on the optical multilayer interference film, as shown in the sectional view of the face panel and the fluorescent surface of a projection cathode ray tube of FIG. 4. It is observed that the light output is lowered to 63% of the initial light output in 7,000 hours. The deterioration of the light output is much larger than that in the conventional projection cathode ray tube having no multilayer optical interference film (curve (I)). As a result of the analysis of the cause of the deterioration, it has been found that browning is produced on the multilayer optical interference film 2 in addition to the glass surface of the face panel 1. Browning on the multilayer optical interference film 2 is produced on, in particular, the layer of titanium oxide ($TiO_2$), which is a high refractive index material. It has been found that browning on the titanium oxide layer is caused by the reduction of $TiO_2$ into $TiO_{2-x}$ by the energy produced when the electron beam having a high energy, which has passed through the gaps of the phosphor layer 3, rushes into the titanium oxide ($TiO_2$) layer. As a high refractive index material, an oxide of a metal is ordinarily used. As a result of investigations of various metals which are optically usable, it has been confirmed that a similar browning phenomenon is caused to one degree or another by using any material.

SUMMARY OF THE INVENTION

Accordingly, it is an object of the present invention to eliminate the above-described problems in the related art and to provide a projection cathode ray tube provided with a multilayer optical interference film which is capable of reducing the deterioration of the light output with time by suppressing the browning phenomenon of the face panel and the multilayer optical interference film.

To achieve this aim, in a projection cathode ray tube according to the present invention, the outermost surface of a multilayer optical interference film consisting of optical thin film layers of alternately superimposed high refractive and low refractive index materials and provided between the fluorescent surface and the face panel is coated with a transparent film of an inorganic material such as silicon dioxide which is optically transparent and stable with respect to the impact of an electron beam. The thickness of the transparent film is not less than 1.0 μm.

In a projection cathode ray tube according to the present invention, since a protective film of an inorganic material, which is optically transparent and stable, is formed on the outermost surface of the multilayer optical interference film so as to protect the multilayer optical interference film from the impact of an electron beam, even an electron beam having a high energy which has passed through the gaps of the phosphor layer loses the energy in the protective film. It is therefore possible to reduce the browning on the multilayer optical interference film and the glass surface of the face panel.

The above and other objects, features and advantages of the present invention will become clear from the following description of the preferred embodiment thereof, taken in conjunction with the accompanying drawings.

DESCRIPTION OF THE PREFERRED EMBODIMENT

An embodiment of the present invention will be explained hereinunder.

Figure 1:
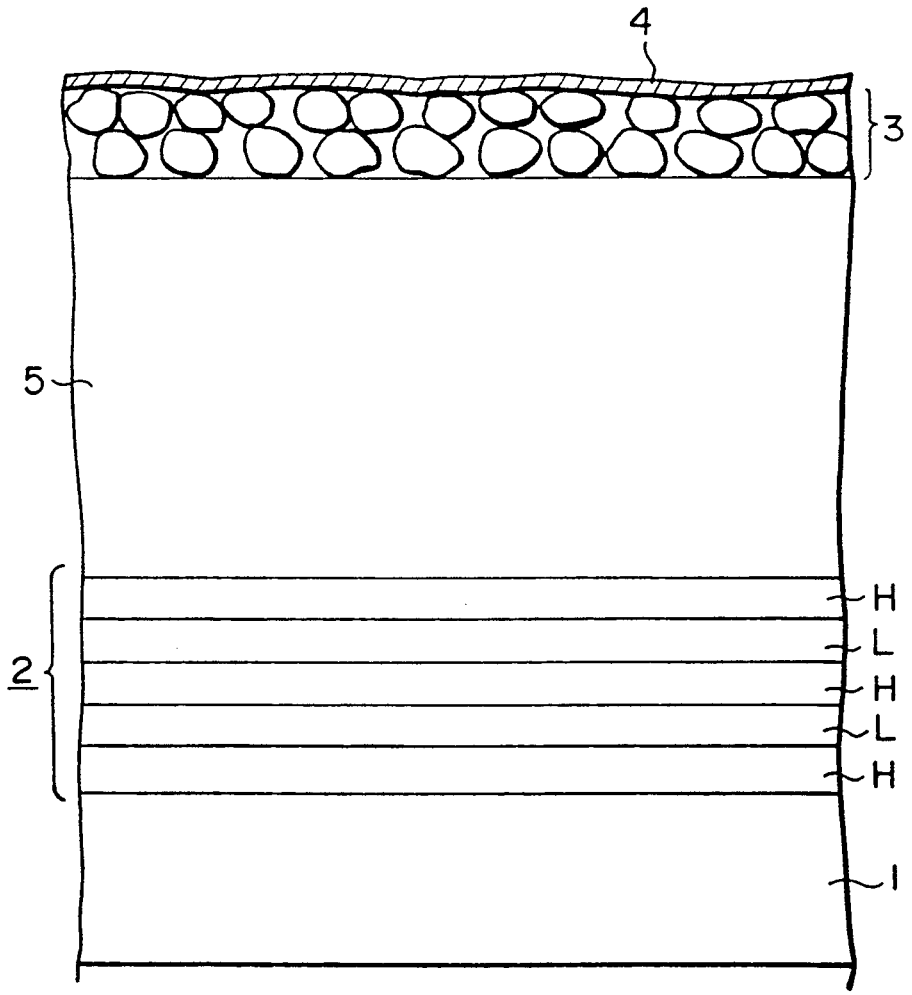
FIG. 1 is a sectional view of an embodiment of a projection cathode ray tube provided with a multilayer optical interference film according to the present invention.

FIG. 1 is a sectional view of the face panel and the fluorescent surface of an embodiment of a projection cathode ray tube provided with a multilayer optical interference film according to the present invention.

Figure 2:
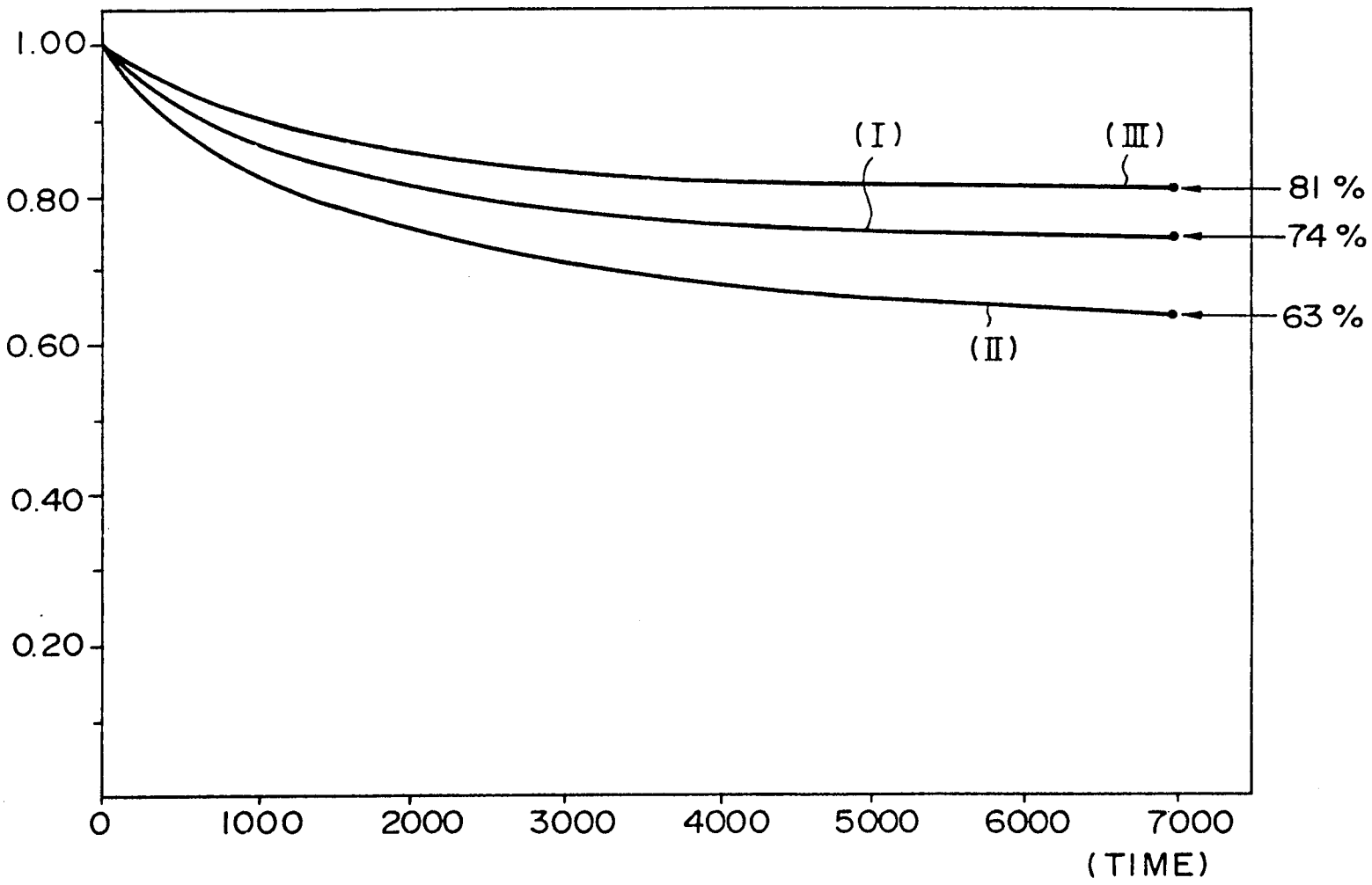
FIG. 2 shows the deterioration of the light output of a projection cathode ray tube with time.
Figure 3:
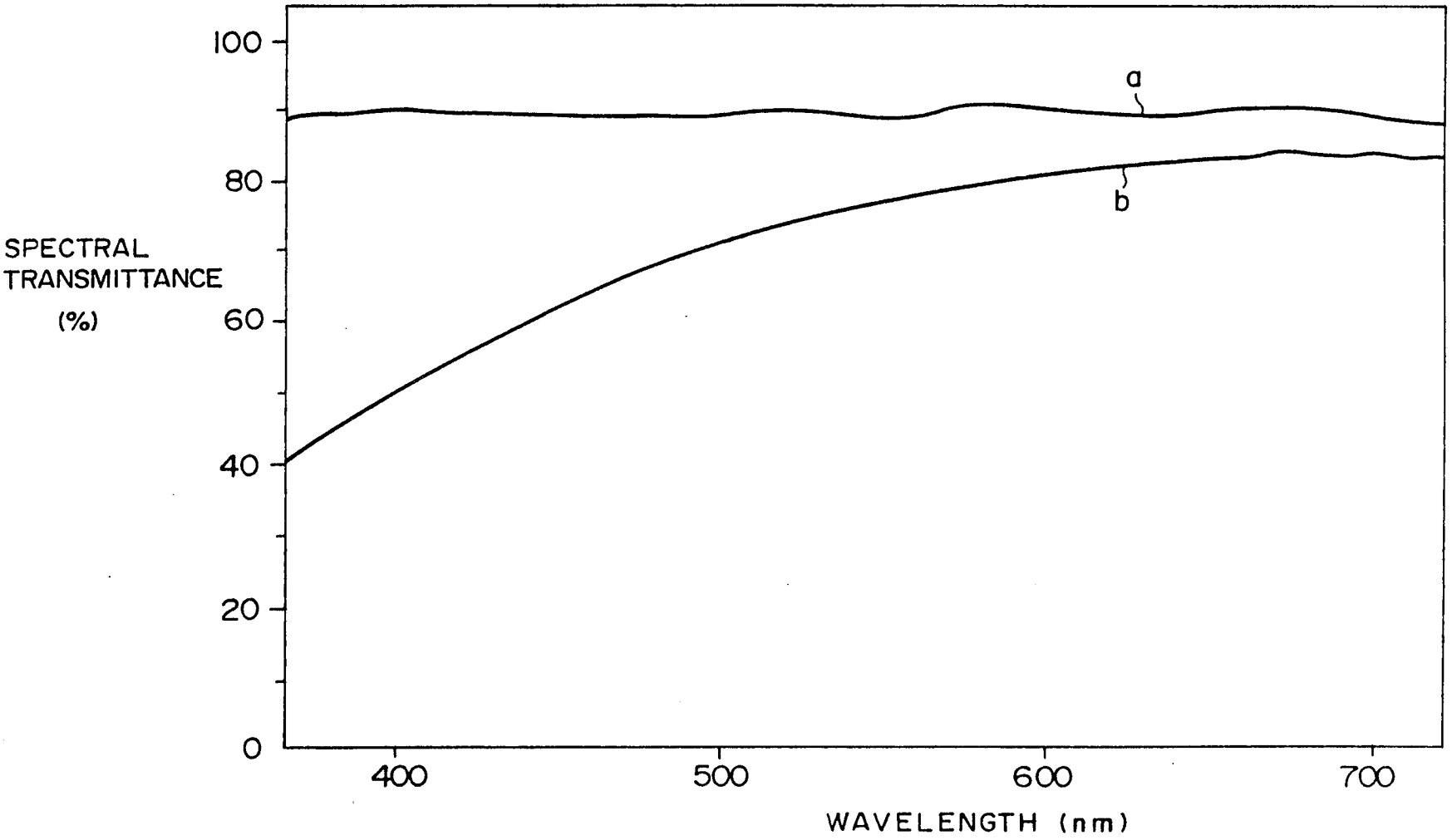
FIG. 3 change in the spectral transmittance due to browning on the glass surface of the face panel.
Figure 4:
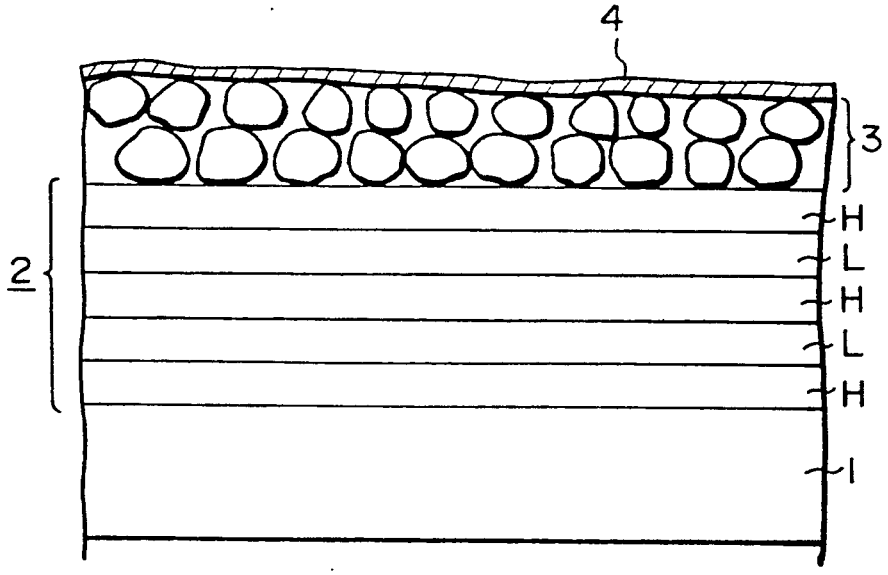
FIG. 4 PRIOR ART
FIG. 4 is a view of a conventional projection cathode ray tube provided with a multilayer optical interference film.

On the inner surface of the face panel 1 are provided a multilayer optical interference film 2 consisting of five alternately superimposed layers of titanium oxide ($TiO_2$) as a high refractive index material and silicon dioxide ($SiO_2$) as a low refractive index material in the same way as in the related art. In the present invention, the outermost surface of the multilayer optical interference film 2 is coated with a transparent film 5 of an inorganic material. A phosphor layer 3 and a metal back coat 4 are provided on the transparent film 5 in the same way as in the related art. It is necessary that the transparent film 5 of an inorganic material not only absorbs the energy of an electron beam having a high energy as much as possible which has passed through the gaps of the phosphor layer 3, but also transmits the light emitted from the phosphor layer 3 with as little loss as possible. It is also necessary that the transparent film 5 of an inorganic material is optically transparent with respect to the multilayer optical interference film 2 provided therebeneath, so that there is a possibility of limiting the refractive index or the film thickness of the transparent film 5 of an inorganic material. It goes without saying that the transparent film 5 of an inorganic material is required to be stable with respect to the impact of an electron beam. A projection cathode ray tube provided with a multilayer optical interference film using a silicon dioxide ($SiO_2$) film of 5.0 μm thick as the transparent film 5 of an inorganic material was produced on an experimental basis. The projection cathode ray tube was continuously operated at a high voltage (accelerating voltage) of 32 KV and a current density on the fluorescent surface of 6 μA. $cm_{-2}$ in the same way as in the related art. A change in the light output with the operation time in this case is shown by the curve (III) in FIG. 2. In this case, due to the electron beam energy absorbing effect of the transparent film (5) of an inorganic material, the browning phenomenon on the multilayer optical interference film 2 and the glass surface of the face panel 1 was suppressed. The deterioration of the light output was 81% of the initial light output in 7,000 hours. This is rather smaller than the deterioration (74% of the initial light output) of the light output of the conventional projection cathode ray tube having no optical multilayer interference film. As the inorganic material for the transparent film 5, various materials other than $SiO_2$ may be used such as the oxides, fluorides and sulfides of inorganic elements. The necessary film thickness of the transparent film (5) of an inorganic material varies depending upon the property of the material used.

The depth d to which an electron beam enters a substance is represented by the well known equation:

$$d=2.5\times10^{-12}\rho^{-1}V^{2}(cm)$$

wherein $\rho$ is the density of the substance and V is the accelerating voltage of the electron beam.

In the case of silicon dioxide ($SiO_2$), the high voltage (accelerating voltage) is 32 KV and the depth to which the electron beam enters silicon dioxide ($SiO_2$) is about 10 μm. However, since the energy of the electron beam is rapidly lost in comparison with the depth to which the electron beam enters, the film thickness of 10 μm is unnecessary. When the film thickness was not less than 1.0 μm, the browning reducing effect was observed, and when the film thickness was 5.0 μm, approximately sufficient effect was exerted. With the use of materials other than silicon dioxide ($SiO_2$), approximately the same effect was obtained.

As described above, according to the present invention, since the outermost surface of the multilayer optical interference film of a projection cathode ray tube is coated with a transparent film of an inorganic material which is stable with respect to the impact of an electron beam, the energy of the electron beam is lost in this protective film, and browning on the multilayer optical interference film and the glass surface of the face panel is reduced. Thus, it is possible to provide a high-quality projection cathode ray tube which is capable of reducing the deterioration of the light output with time.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A method of reducing a Browning phenomenon in a projection cathode ray tube comprising the steps of:

(a) providing a fluorescent surface composed of a phosphor layer on an inner surface of a face panel of the projection cathode ray tube;

(b) providing a multilayered optical interference film, composed of a plurality of optical thin film layers of alternately superimposed high refractive and low refractive index materials, between the fluorescent surface and the face panel; and (c) coating a transparent film of an inorganic material on an outermost surface of the multilayer optical interference film closest to the phosphor layer, to a thickness of at least 1.0 μm to thereby prevent the Browning phenomenon of deterioration of optical characteristics of the multilayer optical interference film, caused over time by bombardment of electron beams while the projection cathode ray tube is active.

2. The method of claim 1 wherein the transparent film is coated to a thickness of at least 5 μm.

3. The method of claim 2, wherein the transparent film of an inorganic material is silicon dioxide ($SiO_2$).

* * * * *